US005620363A

United States Patent [19]

Hepworth

[11] Patent Number: 5,620,363

[45] Date of Patent: Apr. 15, 1997

[54] POWERED GRINDING TOOL

[75] Inventor: Paul S. Hepworth, Guildford, United Kingdom

[73] Assignee: Turner Intellectual Property Limited, United Kingdom

[21] Appl. No.: 281,851

[22] Filed: Jul. 20, 1994

Related U.S. Application Data

[62] Division of PCT/GB93/00079, Jan. 15, 1993.

[30] Foreign Application Priority Data

Jan. 24, 1992 [GB] United Kingdom ..... 9201600
Jan. 15, 1993 [WO] WIPO ..... PCT/GB93/00079

[51] Int. Cl.[6] ..... B24B 41/00

[52] U.S. Cl. ..... 451/231; 451/278; 451/367; 451/374; 451/378; 451/386; 451/406; 451/420

[58] Field of Search ..... 451/359, 364, 451/365, 278, 367, 420, 374, 375, 378, 379, 386, 406, 409, 415, 424, 231, 234

[56] References Cited

U.S. PATENT DOCUMENTS

| | | | |
|---|---|---|---|
| 2,566,809 | 9/1951 | Risley et al. | 451/406 |
| 2,754,634 | 7/1956 | French | 451/409 |
| 3,566,550 | 3/1971 | Piccinino | 451/364 |
| 3,698,140 | 10/1972 | Steadman | 451/375 |
| 3,849,943 | 11/1974 | Thomas et al. | 451/357 |
| 4,142,331 | 3/1979 | MacJannette | 451/364 |
| 4,176,999 | 12/1979 | Mazoff . | |
| 4,347,639 | 9/1982 | Le Tarte | 451/406 |
| 4,655,654 | 4/1987 | Portas | 451/364 |
| 4,937,982 | 7/1990 | Schrock | 451/374 |

FOREIGN PATENT DOCUMENTS

| | | |
|---|---|---|
| 2107327 | 5/1972 | France . |
| 2310835 | 12/1976 | France . |
| 2615774 | 12/1988 | France . |
| 3128501 | 2/1983 | Germany . |
| 0543094 | 2/1942 | United Kingdom . |
| 1233340 | 5/1971 | United Kingdom . |
| 1526169 | 9/1978 | United Kingdom . |
| 2132518 | 7/1984 | United Kingdom . |
| WO82/02507 | 8/1992 | WIPO . |

*Primary Examiner*—Timothy V. Eley
*Attorney, Agent, or Firm*—R. Gale Rhodes, Jr.

[57] ABSTRACT

A powered grinding tool (10) comprising a casing (16) in which is an electric motor (40) which drives a shaft (39) on which is carried a grinding wheel (20) at a work station. The tool casing has undercut slots (24) at opposite sides of its front face for automatic vertical sliding engagement with a selected one of a number of adapters (11–13), each adapter providing a location which, in use, is disposed relative to the grinding wheel so that there is correct positioning between part of an implement that said location and the grinding wheel, for said part to be worked by the wheel. The casing can have the slots (24) on at least one other of its faces to store adapters when they are not in use.

13 Claims, 3 Drawing Sheets

POWERED GRINDING TOOL

CROSS-REFERENCE TO RELATED APPLICATION

This application is a division of PCT GB93/00079, filed on 15 Jan. 1993, which was pending on 20 Jul. 1994.

BACKGROUND OF THE INVENTION

This invention relates to a powered grinding tool primarily for effecting, for example, the sharpening, smoothing, cutting, abrading, honing etc., of implements, such as drill bits, scissors, knives, chisels, planar blades and the like.

Whilst attachments for an electric drill are known which can carry out one or more of the various operations referred to above, their major disadvantage is of course that the drill cannot be used for its intended purpose whilst the attachment is fitted.

SUMMARY OF THE INVENTION

An object of the invention is to provide a powered grinding tool in an efficient and convenient manner.

According to the invention there is provided a powered grinding tool comprising a casing, a motor within the casing, the motor adapted to be driven by power supply means, a rotatable shaft in drivable engagement with the motor, a rotatable grinding wheel to which drive is transmitted, in use, from said shaft, and the casing providing means for automatically securing a selected one of a number of adapters to the tool at a work station thereof and allowing subsequent removal therefrom, each adapter providing a location which, when the adapter is fitted to the tool at said work station, is disposed relative to the grinding wheel so that, in use, there is correct positioning between part of an implement at said location and said grinding wheel for said part to be worked by the wheel.

DESCRIPTION OF THE DRAWINGS

The invention will now be described, by way of example, with reference to the accompanying drawings, in which.

DESCRIPTION OF THE PREFERRED EMBODIMENT

The invention relates to a powered grinding tool which has a work station at which a selected one of several adapters designed for use with the tool can be releasably fitted, the tool having a casing to which, in the disclosed embodiment, two further adapters can be releasably stored when not fitted at the work station. Clearly the casing could be differently arranged to store only one or more than two adapters.

The tool is powered from the mains electricity supply or could have a rechargeable or renewable battery as its power source. The tool has a motor in its casing driving a rotatable shaft on which is carried a grinding wheel at the work station. When fitted at the work station, each adapter provides a location correctly disposed relative to the grinding wheel for part, usually an end, of an implement, to be worked on by the wheel, to be inserted into or onto the location for said working by the wheel. By means of some manual manipulation of the implement in this position, the correct working can be effected.

The tool is advantageous in having its own motor so that it is not an attachment and does not rely on power from a separate tool, such an electric drill. Moreover it is easy to use, allows quick and easy changes of adapters for use with different implements, and conveniently provides storage for adapters not in use, ensuring that when stored they are always at hand and do not become lost.

Figure 1:
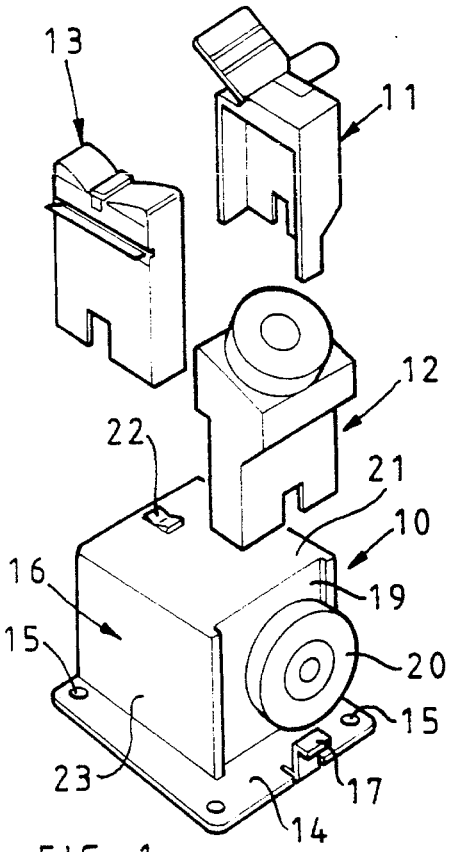
FIG. 1 is an exploded, schematic perspective view showing a powered grinding tool of the invention together with three adapters for use with and storage at the tool.
Figure 2:
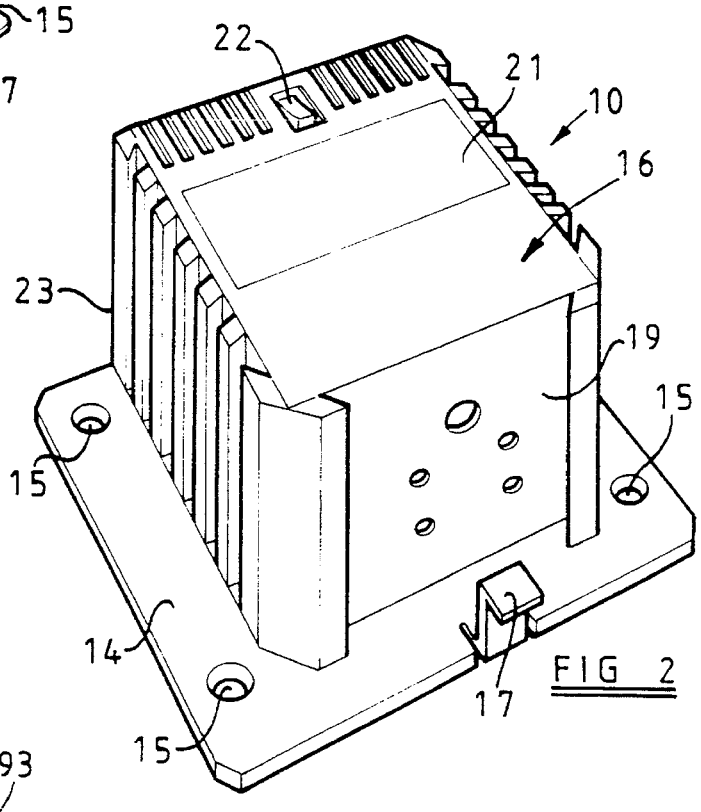
FIG. 2 is a front perspective view of the tool, with a grinding wheel thereof not shown.

FIG. 1 schematically shows the tool 10 with generally three plastics material adapters 11, 12 and 13 respectively. The tool has a rectangular plastics material base 14 with screw holes 15 for securing it to a workbench or other surface. Snap-fittingly engaged with the base is a rectangular plastics material casing 16. Adjacent one of its edges the base has on its upper surface an upstanding, hinged, flexible catch 17, which in use is intended to be manually pressed downward and outward when fitting or removing an adapter to the tool. As will be described, the catch 17 has a inwardly directed projection 18 (FIGS. 4 and 5) facing the tool casing for releasable snap-fit engagement with a front face of each adapter to retain it in place, in use.

Figure 11:
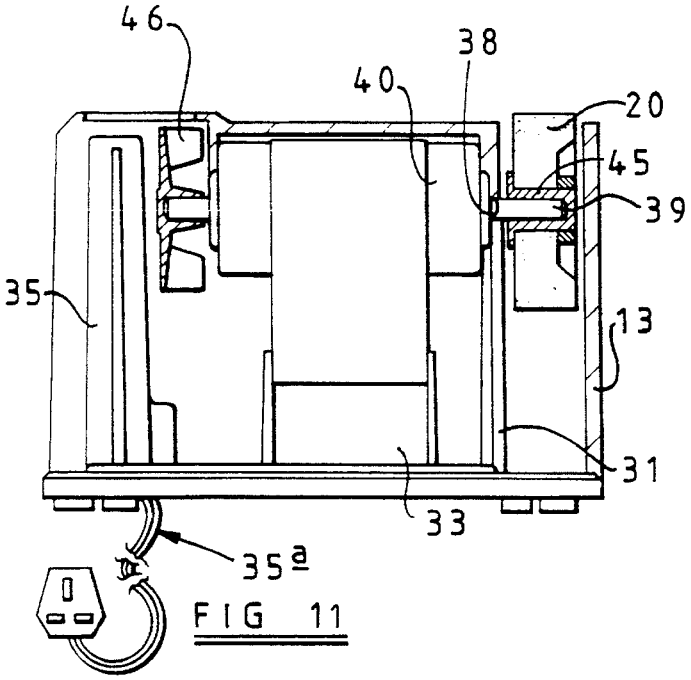
FIG. 11 is a diagrammatic view of part of the inside of the tool showing a motor, fan, grinding wheel and power supply means of the tool.

The catch 17 is spaced from a front surface 19 of the casing, at which is arranged a grinding wheel 20, for example of aluminium oxide, so as to define the work station of the tool. The outer surface of the wheel could be flat, or provided with a central annular recess, as shown in FIG. 11. The upper surface 21 of the casing receives an on-off rocker switch 22 for controlling electrical power to the tool, whilst both casing side surfaces 23 are formed as storage areas for respective adapters. As schematically shown in FIG. 1, and more clearly shown for adapter 13 in FIGS. 3 to 12 and 14, each adapter has its longitudinal side edges formed for complementary sliding engagement with respective undercut grooves 24 at opposite ends of both the front surface 19 and also the two side surfaces 23. As shown in FIG. 8, the grooves in this example are half of a dove-tail groove and the two complementary half dove-tail projections 25 are shown for adapter 13 in FIGS. 12 to 14. Accordingly any one adapter can engagingly be slid down the front of the tool at the work station and fixed by said catch 17, or can engagingly be slid down either side of the tool to be stored thereat.

Shown in FIG. 1 are three adapters, each for use with different forms of implement. Adapter 11 is for use with sharpening chisels and planes, adapter 12 is for sharpening high speed drill bits, whilst adapter 13 is for sharpening knives and scissors. As explained above all have projections 25 at their respective opposite longitudinal edges.

Figure 4:
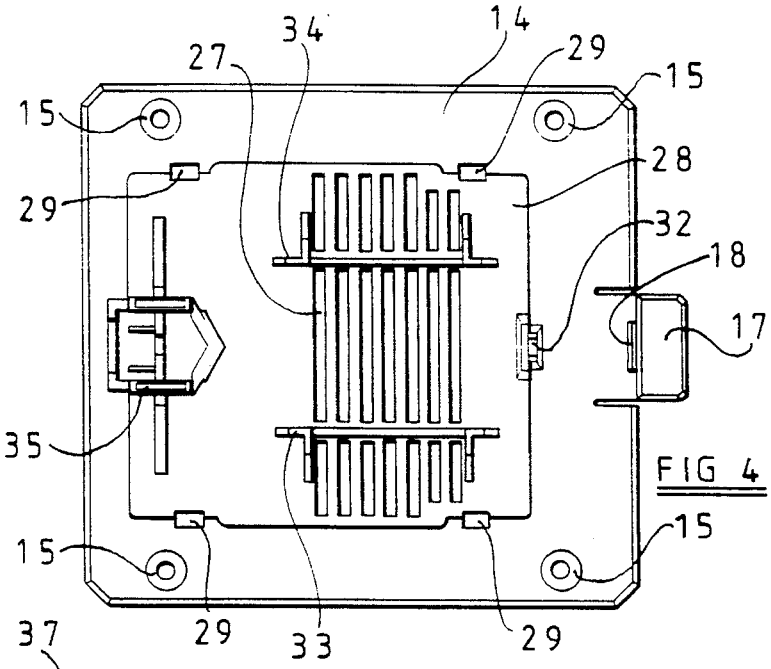
FIG. 4 is a top plan view of a base of a casing of the tool.
Figure 5:
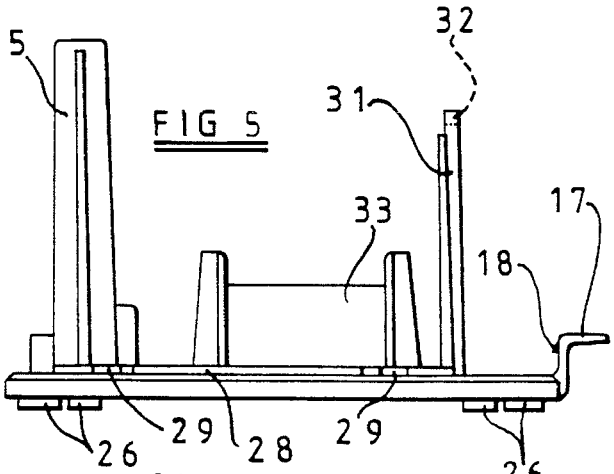
FIG. 5 is a side view of the casing base of FIG. 4.

FIGS. 4 and 5 show the base 14 of the tool. The base has support feet 26 on its underside and is formed with central slots 27 through a central slightly raised rectangular area 28 onto which the casing 16 is fitted on assembly. Adjacent the four corners of the area 28 on two sides thereof are latch openings 29 for snap-fittingly receiving flexible latches 30 complementarily arranged at the bottom of the grooves 24 of the casing, as shown in FIGS. 6, 7, 9 and 10.

Upstanding from a front edge of the area 28 at the centre thereof is an integral tapered finger 31 which has a semi-circular recess 32 in its top surface. Upstanding integrally from the centre of the area 28 at opposite longitudinal ends respectively of an inner set of the slots 27 are support ribs 33, 34. Upstanding integrally from just inside a rear edge of the area 28 at the centre thereof is a guide structure 35.

Figure 6:
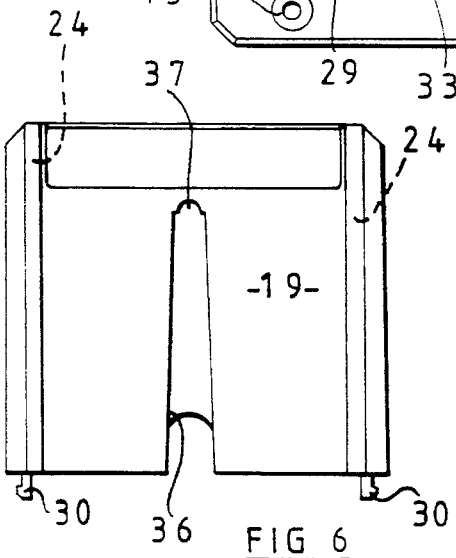
FIG. 6 is a front view of the casing, in a form different from FIG. 2.

The casing is shown in FIGS. 6 to 10. FIG. 6 shows the front surface 19 having the longitudinal half dove-tail, undercut grooves 24 along its sides and the latches 30 thereunder. In its centre it has a tapering opening 36 which is generally complementary to and able to slide over and engage on the finger 31. However the top of the finger 31 remains spaced slightly below the inner top surface 37 of the opening which is semi-circular and with the recess 32 defines a circular opening 38 for a drive shaft 39 of a 220 V A.C. motor 40 of the tool, as shown in FIG. 11.

Figure 7:
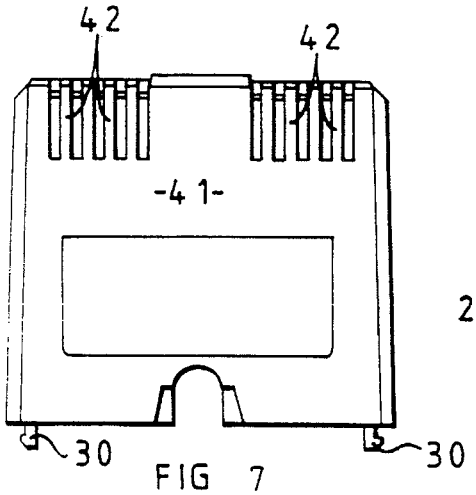
FIGS. 7 to 9 are respectively a rear view, a top view and a side view of the casing.
Figure 8:
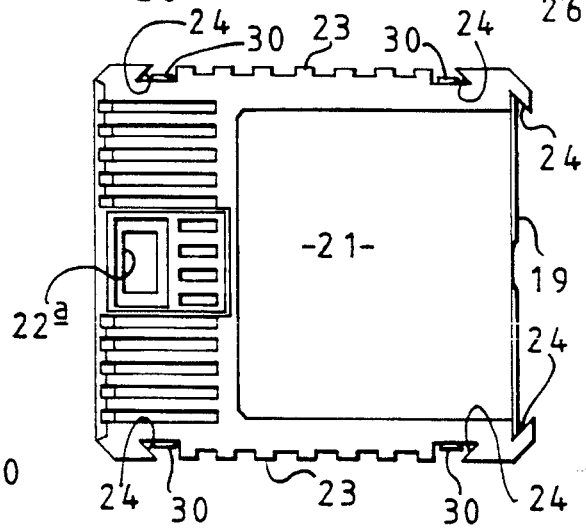

FIG. 7 shows the rear surface of the casing, denoted by numeral 41, this having open slots 42 at its upper edge, these slots continuing into the upper surface 21 of the casing (FIG. 8) at opposite sides of an opening 22*a* for the switch 22.

Figure 9:
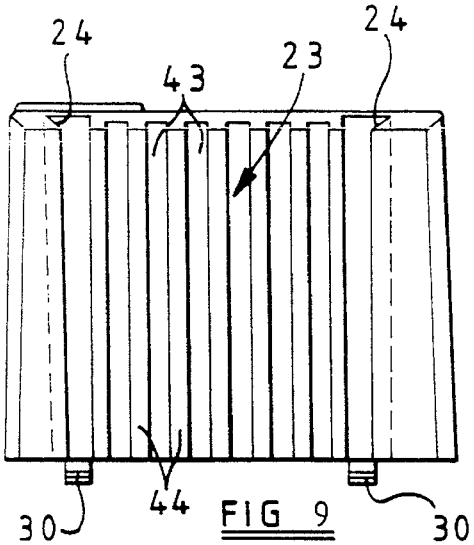
Figure 10:
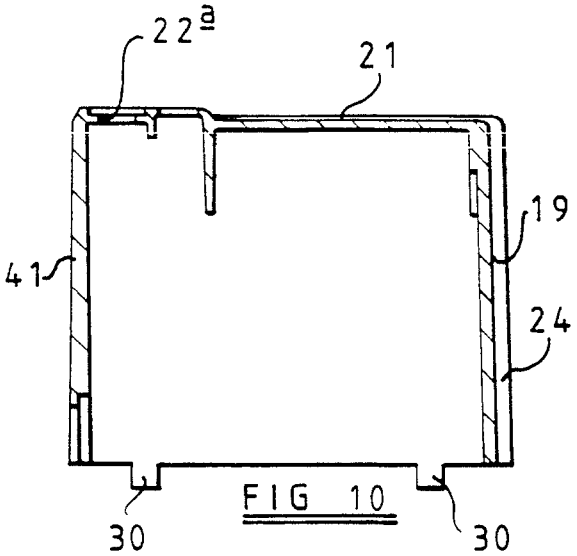
FIG. 10 is a vertical section through the casing.

Each of the side surfaces 23 of the cases has said grooves 24 respectively at its opposite ends as shown in FIGS. 8 and 9, whilst between the grooves are a series of parallel upright ribs 43 separated by parallel grooves 44, the ribs and grooves each having a generally rectangular cross-section.

FIG. 11 shows the motor 40, carried in the casing by means including the support ribs 33, 34, and held both axially and radially. In this embodiment the drive shaft 39 is in permanent, direct drivable engagement with the motor, but alternatively the engagement could be through gearing. The end of the shaft projects through opening 38 to terminate outside of the casing front surface 19 where it carries a plastics material collar 45 with a left hand thread, on which collar is the grinding wheel 20, driven, in use, directly, as shown, or alternatively indirectly, by the motor 40 and shaft 39, and secured in place by an end nut. When an adapter 11, 12 or 13 is fitted at this work station defined at the wheel 20, it substantially shrouds the wheel, which is itself received in a channel part of the adapter, as schematically shown for adapter 13 in FIG. 11. At the rear end of the shaft 39, which protrudes from the motor, a plastics material fan 46 is carried thereon so as to be driven by rotation of the shaft, in use, to effect cooling of the interior of the casing.

As will be appreciated from the foregoing description of the base 14 and casing 16, the casing can be snap-fittingly engaged with the base merely by correctly relatively positioning the latches 30 and latch openings 29 and then forcing the components together. Once engaged together, wires 35*a* supplying electrical power for the motor pass up through the guide structure 35 for co-operation with the switch 22, which is itself arranged to control the motor.

Having now described the body of the tool, the adapter 13, already briefly referred to will now be more fully described.

Figure 12:
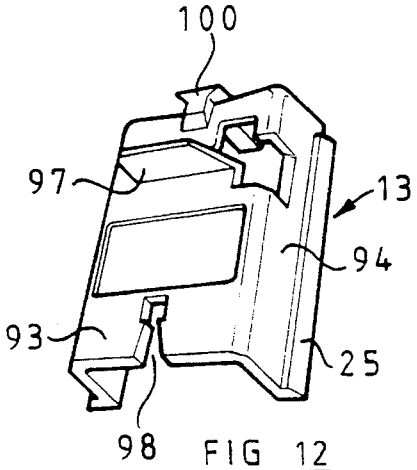
FIGS. 12 to 14 respectively are a front perspective view, a side view and a top view of the adapter of FIG. 3.
Figure 13:
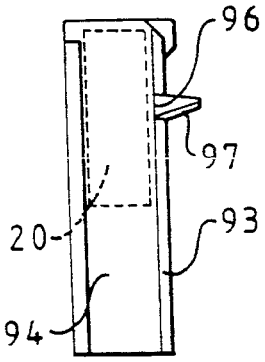
Figure 14:
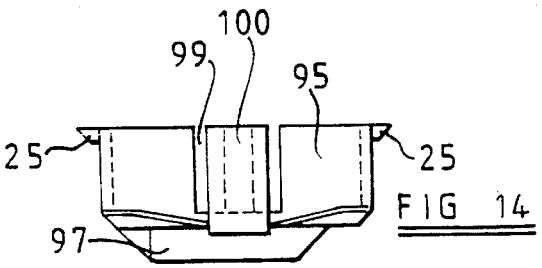

FIGS. 12 to 14 show the adapter 13 for sharpening knives and scissor blades by means of the grinding wheel 20. The adapter 13 is in the form of a channel having a base 93 with parallel sides 94, an open lower end and an upper end generally closed by a wall 95.

Figure 3:
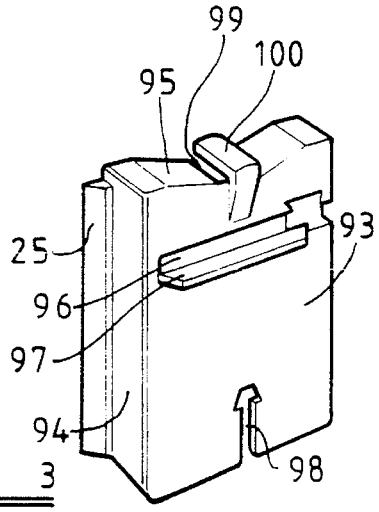
FIG. 3 is a perspective view of an adapter for use in sharpening knives and scissors.

As shown also in FIG. 3, the front surface of the adapter, constituted by the base 93 of the channel form, has a horizontal slot 96 extending across it. The slot widens upwardly towards the right hand side 94 of the channel and widens downwardly at said right hand side 94, the slot extending from the base into said right hand side 94. A forwardly directed horizontal platform 97 extends integrally from the front surface along the lower edge of the slot 96, the platform extending from the left hand edge of the front surface, where it is slightly stepped downwardly and has its outer face chamfered, to the position where the slot widens downwardly, its outer face again being chamfered at this one of its ends.

Extending vertically upwards from the centre of the bottom edge surface of the base 93 is an arrow-shaped slot 98, to receive projection 18. The slot could be merely a rectangular aperture.

The wall 95 has a central rectangular opening 99 extending inwardly from its free edge surface and the parts of the wall at either side thereof slope downwardly towards it, as shown in FIG. 3. Disposed over the opening 99 is a tongue 100 extending rearwardly from the front surface of the adapter with which it is integrally formed. The opposite sides of the tongue are downwardly and inwardly sloped.

FIG. 13 shows the position of the grinding wheel 20 when the adapter 13 is fitted by means of its projections 25 at the work station of the tool with the catch 17 engaging it in place. Scissors, knives and like blades can be sharpened by using this adapter. It is intended that scissor blades can be inserted into the slot 96 whilst supported by platform 97, manual manipulation of each blade along the slot and inwardly thereof against the side of the wheel providing the required correct sharpening. Knives are intended to be arranged on either of the sloping parts of top surface 95, with an end of the knife being guided by the sloping lead-in side surface of the tongue to engage the cylindrical surface of the wheel for correct sharpening. Again suitable manual manipulation can be effected to produce the desired degree of sharpening.

It will be appreciated that further adapters to those disclosed can be sold as part of the tool or as separate add-on components. The three adapters 11, 12 and 13 are considered to provide common implement working requirements and further adapters could be for more specialised use. Further adapters would of course have projections 25 and lower slot (or equivalent) to engage and lock with the casing and base respectively. Normally the further adapters would be of plastics material.

In an alternative form of the tool 10, the motor could drive a further shaft, like the shaft 39, but which projects from the rear of the casing to define a further work station at which adapters might or might not be engageable. Gearing could be provided in the casing so that the two wheels could operate or be operated at different rotational speeds. The permanent second wheel could be of white stone for honing.

The adapters which provide for utilisation of a grinding wheel accurately position a location for part of an implement to be worked on, when it is engaged at the work station. Moreover each location provides some support for the implement, although it would normally be necessary for the implement to be held during the working by the wheel. Any material ground from the implement during working will fall between the casing front surface and the adapter, to the base, from where it can easily be cleared once the adapter is removed.

Although the part dove-tail slot and projection arrangement disclosed is particularly satisfactory for slidingly engaging an adapter at a work station or a storage position of the casing, any suitable alternative means could be used, even screws or the like.

The grinding wheel of the tool can have a flat or recessed front surface. A recess is more desirable as it accommodates the end of the motor shaft and fixing nut below the front grinding surface. When the tool operates, for example, with an adapter which in use involves the backing off masonry drill bits, there is a benefit with a recessed wheel in that using the inside edge of the recess enables grinding to avoid the flute end point. The use of different wheel compositions (grit size and type) is selected to match the tool's typical material. For example tungsten carbide requires what is commonly known as green grit or diamond, whilst with honing, which is usually a finer grinding process, and sometimes used wet, the grit is usually white alumina and of finer grade.

I claim:

1. A powered grinding tool comprising a casing, a motor within the casing, the motor adapted to be driven by power supply means, a rotatable shaft in drivable engagement with the motor, a rotatable grinding wheel to which drive is transmitted from said shaft, and the casing providing engagement means for temporarily securing a selected one of a number of adapters to the tool at a work station thereof, each adapter providing a location which, when the adapter is fitted to the tool at said work station, is disposed relative to the grinding wheel so that there is correct positioning between part of an implement at said location and said grinding wheel for said part to be worked by the wheel, said engagement means adapted to secure the selected adapter by guiding sliding, so that the selected adapter is secured in a snap-fit to the tool, in that there is manually operable catch means of the snap-fit allowing subsequent removal of the adapter from the tool, and in that the engagement means comprise a pair of spaced grooves or projections at the casing with which a pair of spaced complementary projections or grooves respectively of the selected adapter (11, 12, 13) engages.

2. A tool as claimed in claim 1, wherein said casing has storage means for releasably storing at least one of said adapters when the or each adapter is not fitted to the tool at said work station.

3. A tool as claimed in claim 2, wherein each adapter has a lower portion extending from its location, the lower portion being of generally channel shape having spaced sides, respective means at said sides being engageable with respective cooperating means at the casing to retain the adapter at said work station against lateral movement.

4. A tool as claimed in claim 3, wherein said means at the sides of an adapter and at the casing are projections and complementary undercut slots respectively.

5. A tool as claimed in claim 4 wherein said casing is four sided, having said undercut slots or said complementary projections at one side defining said work station, and also at least one other side.

6. A tool as claimed in claim 1, wherein said tool includes a base and wherein said casing is snap-fittingly engaged with said base.

7. A tool as claimed in claim 1, wherein said shaft is directly driven by the motor, one end of the shaft projecting out of the casing at said work station and having said grinding wheel attached thereto.

8. A tool as claimed in claim 7, wherein the other end of the shaft is disposed in the casing and upon rotation of the shaft drives a fan in the casing.

9. A tool as claimed in claim 1, wherein the power supply means is mains power.

10. A tool as claimed in claim 1, wherein the power supply is battery power.

11. Apparatus for grinding a plurality of different implements, comprising:

support means;

a grinding wheel mounted generally horizontally and rotatably on said support means and at least a portion of said grinding wheel generally residing in a vertical plane;

a pair of parallel generally vertically disposed grooves generally residing in said vertical plane, and spaced laterally from said grinding wheel;

at least one adapter provided with receiving means for receiving one of said implements and for facilitating placement of the one implement in grinding engagement with said grinding wheel, said adapter provided with a pair of generally parallel projections generally complementary in shape to said grooves and for being slidably received within said grooves to place said adapter in sliding engagement with said support means; and catch means provided on said support means and being engageable by said adapter as said adapter is placed in sliding engagement with said support means, said catch means operable upon engagement with each adapter to temporarily secure each adapter to said base means during grinding of the implements.

12. The apparatus according to claim 11, wherein each of said grooves are half of a dove-tail groove; and wherein each of said projections are half of a dove-tail projection.

13. The apparatus according to claim 11, wherein said receiving means include a support member for supporting a portion of one of the implements and a slot through which another portion of the one implement is inserted to engage said grinding wheel.

* * * * *